US005203184A

United States Patent [19]

Lonati et al.

[11] Patent Number: 5,203,184

[45] Date of Patent: Apr. 20, 1993

[54] SINGLE-CYLINDER CIRCULAR MACHINE WITH IMPROVED PLATEN ACTUATION, IN PARTICULAR FOR MANUFACTURING SOCKS, STOCKINGS AND THE LIKE

[75] Inventors: Francesco Lonati; Ettore Lonati; Fausto Lonati; Tiberio Lonati, all of Brescia, Italy

[73] Assignee: S.F.I.M. S.r.L., Brescia, Italy

[21] Appl. No.: 790,622

[22] Filed: Nov. 12, 1991

[30] Foreign Application Priority Data

Nov. 15, 1990 [IT] Italy ..... 22063 A/90

[51] Int. Cl.[5] ..... D04B 9/06

[52] U.S. Cl. ..... 66/95; 66/28

[58] Field of Search ..... 66/28, 95, 104

[56] References Cited

U.S. PATENT DOCUMENTS

| | | | |
|---|---|---|---|
| 3,513,667 | 5/1970 | Billi | 66/95 |
| 3,969,911 | 7/1976 | Lonati | 66/28 X |
| 3,974,663 | 8/1976 | Vimci et al. | 66/95 X |
| 4,454,729 | 6/1984 | Lonati | 66/28 |
| 4,718,256 | 1/1988 | Lonati | 66/95 |
| 5,052,196 | 10/1991 | Turini | 66/95 X |

FOREIGN PATENT DOCUMENTS

| | | | |
|---|---|---|---|
| 0107849 | 5/1984 | European Pat. Off. . | |
| 675852 | 3/1966 | France | 66/28 |
| 757242 | 3/1971 | France | 66/95 |
| 2438699 | 5/1980 | France . | |
| 12528 | 8/1890 | United Kingdom | 66/28 |

*Primary Examiner*—Clifford D. Crowder
*Assistant Examiner*—John J. Calvert

[57] ABSTRACT

The single-cylinder circular machine comprises a substantially vertical needle cylinder which is rotatable about an axis and supports a plurality of needles which are arranged in axial grooves of the outer skirt of the needle cylinder and can move individually along directions which are parallel to the needle cylinder axis. A platen is arranged coaxially above the needle cylinder and is supported, so as to be rotatable about the needle cylinder axis, by the supporting structure of the machine. The machine comprises first connecting members which can be controllably activated or deactivated in order to rigidly associate the platen, in its rotation about the axis, with the needle cylinder, and second connecting members arranged on a wing of the platen which extends inside the needle cylinder and on a portion of the inner surface of the needle cylinder which faces the wing. The second connecting members interact magnetically with one another, thereby transmitting rotary motion of the needle cylinder to the platen.

16 Claims, 4 Drawing Sheets

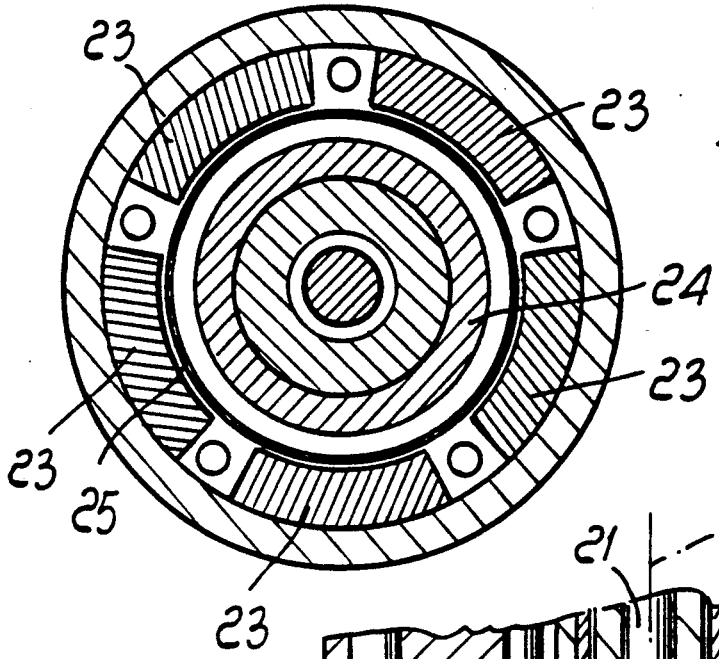
Fig. 4
Fig. 3
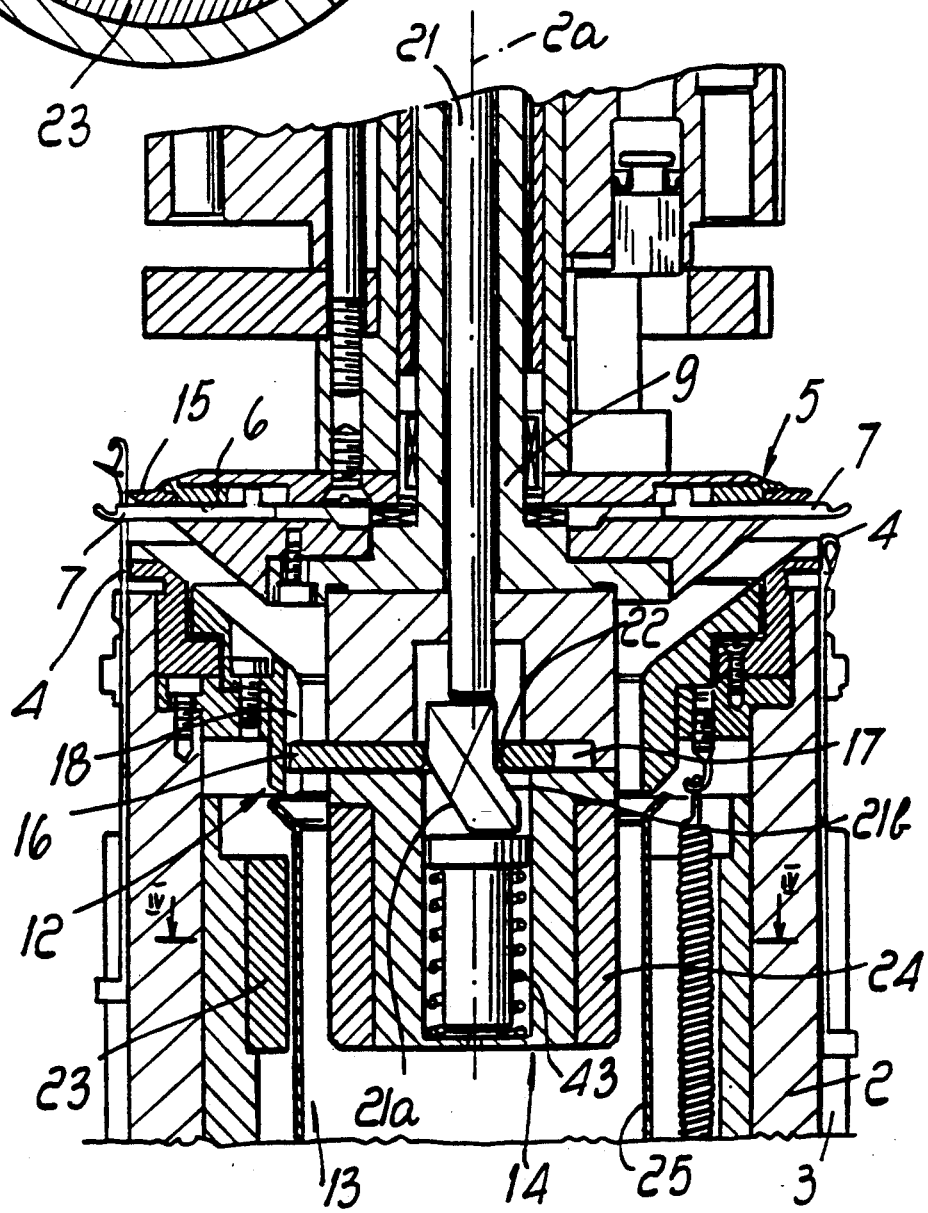

SINGLE-CYLINDER CIRCULAR MACHINE WITH IMPROVED PLATEN ACTUATION, IN PARTICULAR FOR MANUFACTURING SOCKS, STOCKINGS AND THE LIKE

BACKGROUND OF THE INVENTION

The present invention relates to a single-cylinder circular machine with improved platen actuation, in particular for manufacturing socks, stockings and the like.

As is known, single-cylinder circular machines for manufacturing socks, stockings and the like are generally constituted by a vertically arranged needle cylinder which can be actuated with a rotary motion about its own axis and supports a plurality of needles which are accommodated in axial grooves defined on its outer surface. Said needles are actuated individually by means of cams which are arranged around the needle cylinder and define paths which can be followed, during the rotation of the needle cylinder with respect to said cams, by a needle heel which protrudes from the needle cylinder.

The paths defined by said cams have rising portions and descending portions in order to cause the reciprocating movement of the needles along the grooves of the needle cylinder and to make said needles take up the threads which are fed thereto and form the stitches which compose the sock or stocking.

A platen is coaxially arranged above the needle cylinder; radial grooves are defined on its upper face and slidingly accommodate a plurality of needles or hooks, depending on the type of machine or product to be manufactured.

The number of needles or hooks of the platen is equal to the number of needles provided in the needle cylinder, and when the needles or hooks of the platen knit, the cylinder and the platen must be rotated in a mutually rigid manner, with each hook or needle of the platen arranged between two contiguous needles of the cylinder in order to avoid mutual interference.

Furthermore, in many types of machine the platen is provided, on its upper face, with a coaxial circular cutter which is used to cut the threads when their knitting ends. More particularly, at the end of the knitting of a thread, said thread remains engaged with the last needle which knitted it and is lowered into the needle cylinder; the thread is taken up by a tooth of the cutter, which rotates together with the platen and the needle cylinder, and is moved to a fixed abutment, termed knife, which cooperates with the cutter in order to cut the thread.

The platen is generally rotated by means of a gear connection to the transmission which actuates the needle cylinder, so as to avoid angular displacements between the cylinder and the platen.

The U.S. Pat. No. 4.580.420 granted Apr. 8, 1986, discloses a circular machine for manufacturing socks wherein the rotational connection between the platen and the needle cylinder is obtained by means of an oscillating lever which is pivoted to the platen with its upper end and extends inside the needle cylinder. The lower end of said lever can be controllably engaged, by using its ability to oscillate, with an axial groove defined on the inner surface of the needle cylinder, so that the platen is rotated by the needle cylinder. Said rod is disengaged from the needle cylinder only at the end of the forming of the sock in order to allow its outward unloading.

Although this solution eliminates the gear transmission for the actuation of the platen, it has some disadvantages.

In fact, since the sock descends around the rod connecting the platen to the cylinder during knitting, the rod must have an adequate length. Due to this fact, the torsional deformability of the rod can cause unwanted displacements between the cylinder and the platen, with the risk of interference between the needles of the cylinder and the hooks of the platen. Furthermore, since the rod is in any case generally shorter than the product, folds or creases occur in the sock and, with some types of thread, remain even after ironing it. Another disadvantage is a reduction in the efficiency of the pneumatic aspiration to which the sock is subjected during manufacture.

In other types of machine, the connection between the needle cylinder and the platen can be defined as mixed. In fact, a rod of the type described in the above mentioned patent is provided, but it is shorter in order to provide a precise connection between cylinder and platen; furthermore, when said connection is not used, the platen is rotated, with a speed which is substantially equal to that of the cylinder, by means of an independent motor which is connected to the platen by means of a transmission.

In this case, the precision connection between platen and cylinder is used generally only at the beginning of the knitting of the sock, i.e. during the knitting of the trimming, when the actuation of the hooks is required, whereas when the hooks do not knit, the rotation of the platen and the possibility to use the cutter to cut the threads are allowed by the independent motor.

However, even this solution is not free from disadvantages. In fact, higher costs arise with respect to the previously described solution; said costs are mainly due to the cost of the independent motor and to additional costs for the higher energy consumption required for its actuation. Furthermore, the presence of the motor arranged above and laterally to the platen constitutes an unwanted bulk in the region intended for supporting the spools of thread which feed the machine, and makes it difficult to raise the platen.

In any case, problems also occur in connecting the needle cylinder and the platen with gears, since the plays among the various gears can alter the correct mutual arrangement of needle cylinder and platen.

SUMMARY OF THE INVENTION

The aim of the present invention is to solve the above described problems by providing a circular knitting machine wherein the actuation of the platen can meet the various knitting requirements despite lower production and running costs than conventional machines.

Within the scope of this aim, an object of the invention is to provide a knitting machine wherein the platen actuation elements do not create bulk problems with regard to other elements of the machine.

Another object of the invention is to provide a machine which offers adequate assurances of precision in the actuation of the platen without requiring a gear connection between the needle cylinder and the platen.

Another object of the invention is to provide a knitting machine wherein the platen actuation elements do not penalize the manoeuverability of the platen.

This aim, these objects and others which will become apparent hereinafter are achieved by a single-cylinder circular machine with improved platen actuation, particularly for manufacturing socks and stockings, which comprises a substantially vertical needle cylinder which can be rotationally actuated about its own axis and supports a plurality of needles arranged in axial grooves defined in the outer skirt of the needle cylinder and can move individually along directions parallel to the axis of the needle cylinder, a platen being arranged coaxially above the needle cylinder and supported by the supporting structure of the machine for rotation about said axis, characterized in that it comprises first connecting means which can be controllably activated or deactivated in order to rigidly rotationally associate, about said axis, said platen with said needle cylinder, and second connecting means arranged on a wing of the platen which extends inside the needle cylinder and on a portion of the inner surface of the needle cylinder which faces said wing, said second connecting means interacting magnetically with one another to transmit rotary motion of the needle cylinder to said platen.

BRIEF DESCRIPTION OF THE DRAWINGS

Further characteristics and advantages of the invention will become apparent from the description of a preferred but not exclusive embodiment of the machine according to the invention, illustrated only by way of non-limitative example in the accompanying drawings, wherein:

FIG. 3 is a view of another enlarged portion of FIG. 1;

FIG. 4 is a sectional view of FIG. 3, taken along the axis IV—IV;

DESCRIPTION OF THE PREFERRED EMBODIMENTS

Figure 1:
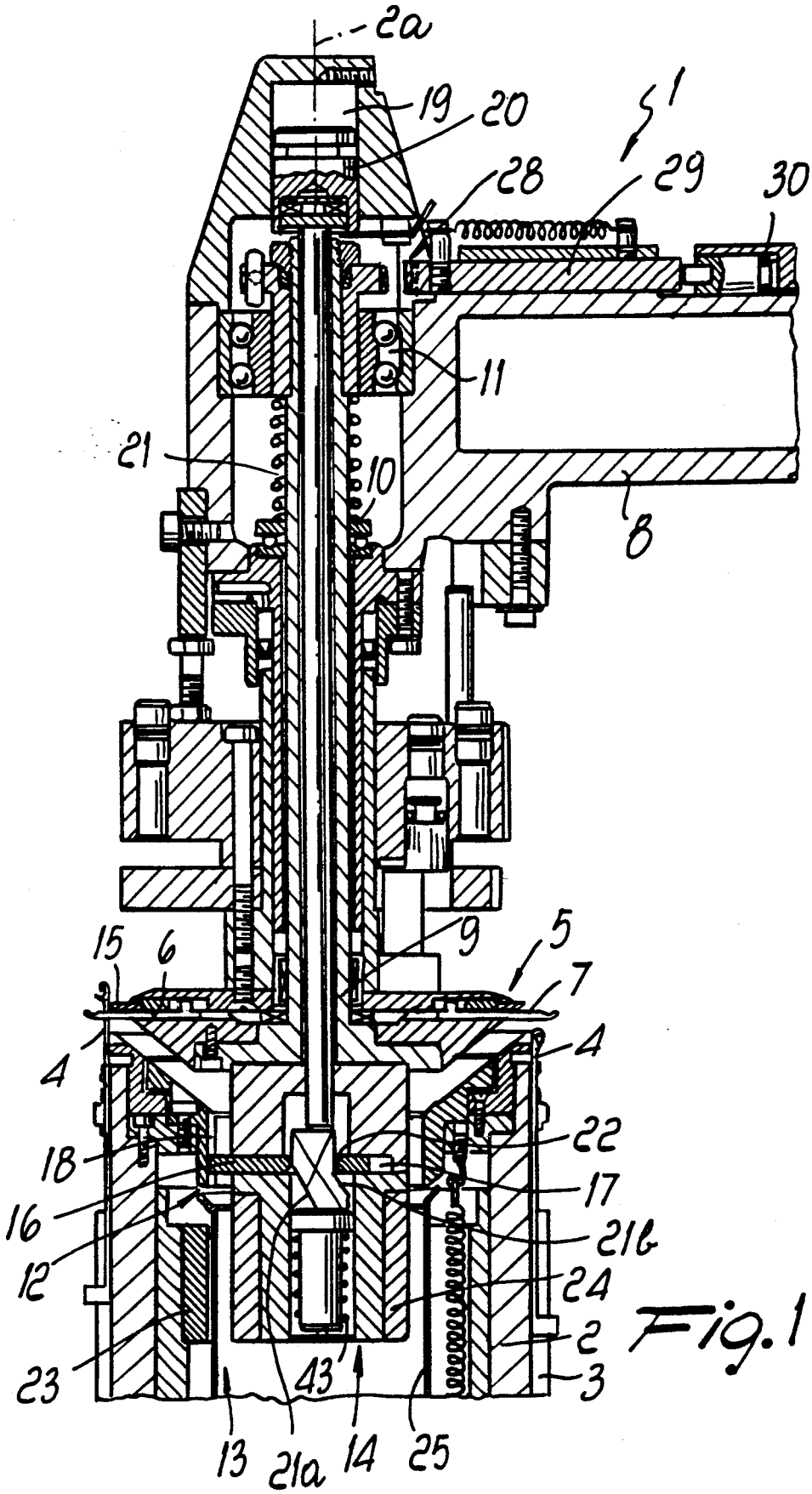
FIG. 1 is a schematic axial sectional view of the upper portion of a machine according to the invention.
Figure 2:
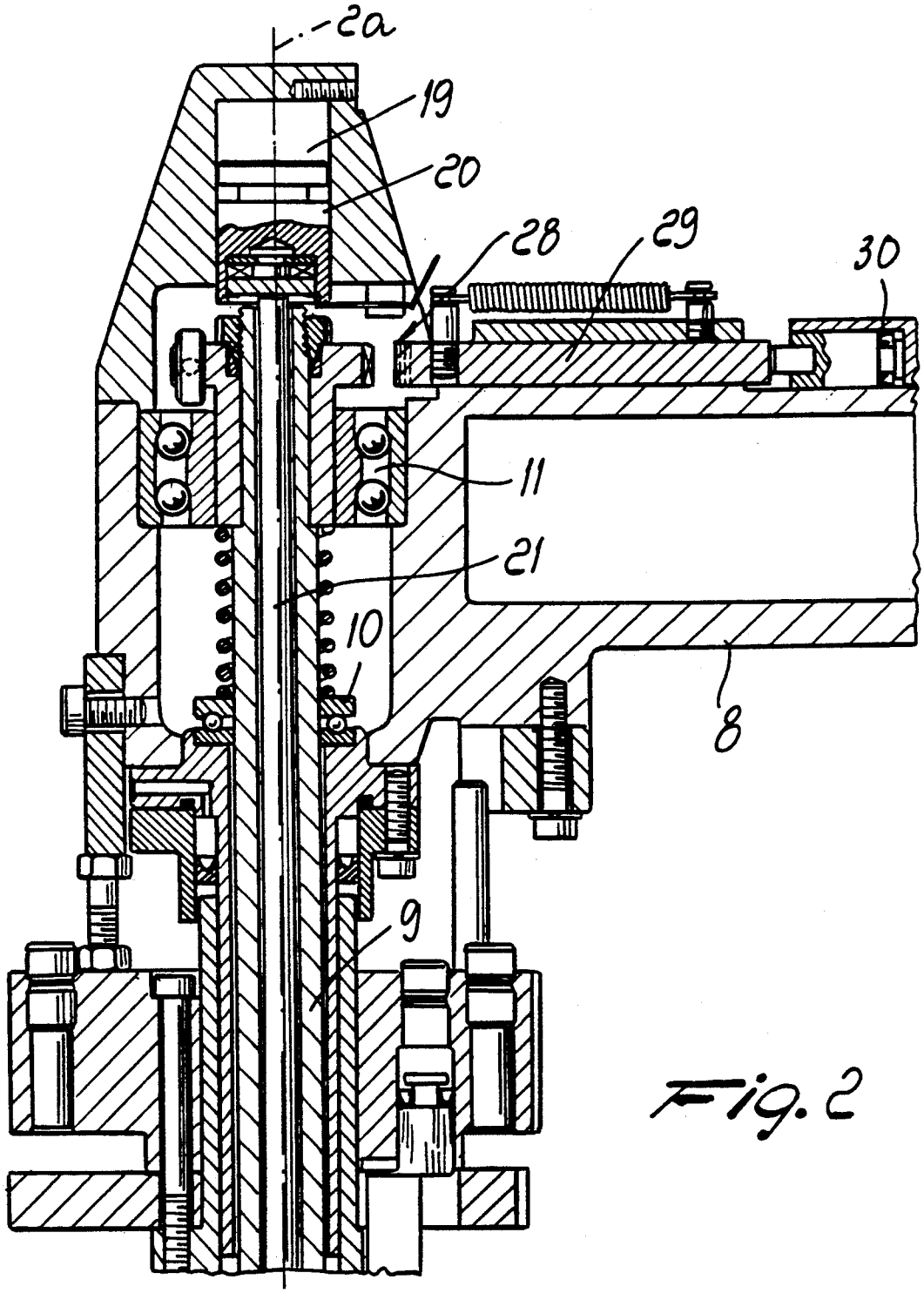
FIG. 2 is a view of an enlarged portion of FIG. 1.

With reference to the above figures, the knitting machine according to the invention, generally indicated by the reference numeral 1, comprises, in a known manner, a needle cylinder 2 which is arranged vertically and is supported by the supporting structure of the machine so as to be rotatable about its own axis 2a. A plurality of axial grooves 3 is defined on the outer skirt of the needle cylinder, and a needle 4 is slidingly accommodated in each of said grooves.

Above the needle cylinder 2 there is a platen 5 in which a plurality of radial grooves 6 is defined in a known manner; each groove slidingly accommodates a conventional hook 7. The number of the radial grooves 6 of the platen is equal to the number of the axial grooves 3 of the cylinder. The platen is arranged coaxially to the cylinder 2 and is supported, so as to be rotatable about the axis 2a, by an arm 8 of the supporting structure of the machine.

More particularly, the platen 5 is fixed to the lower end of a shaft 9 which is coaxial to the platen and is supported, so as to be rotatable about the axis 2a, by the arm 8 by means of bearings 10 and 11. A disk-shaped cutter 15 for cutting the threads is coaxially associated with the platen 5 in a per se known manner.

According to the invention, the machine comprises: first connecting means, generally indicated by the reference numeral 12, which can be controllably activated or deactivated in order to rigidly associate the platen 5 and the needle cylinder 2 in their rotation about the axis 2a; and second connecting means, generally indicated by the reference numeral 13, which are arranged on a wing 14 of the platen 5 which extends inside the needle cylinder and on an inner portion of the needle cylinder which faces the wing 14; said second connecting means mutually interact magnetically, transmitting the rotary motion from the needle cylinder 2 to the platen 5.

The first connecting means 12 comprise a key 16 which is accommodated, so as to be slideable in a radial direction with respect to the needle cylinder, in a passage 17 defined in the wing 14.

A seat 18 is defined on the inner surface of the needle cylinder 2, and an end of the key 16 can couple therein. Conveniently, said seat 18 is elongated in a direction parallel to the axis 2a of the needle cylinder in order to allow relative axial movements between the needle cylinder and the platen.

In order to move the key 16 radially, engaging or disengaging with respect to the seat 18, there are actuation means which comprise a fluid-actuated cylinder 19 defined in the supporting structure of the machine proximate to the upper end of the shaft 9. The piston 20 of the cylinder 19 acts on the upper end of a rod 21 which can slide axially in the shaft 9 and is prevented from performing axial translatory motions.

The lower end of the rod 21 is coupled to the key 16 so that an axial sliding of the rod 21 causes a radial movement of the key 16. More particularly, the lower end of the rod 21 is coupled inside a hole 22 defined in the key 16 by means of two portions 21a and 21b which are shaped like an inclined plane with respect to the axis 2a. The two portions 21a and 21b engage the opposite ends of the hole 22, along the sliding direction of the key 16, in order to obtain, by means of the reciprocating motion of the rod 21 along the axis 2a, a reciprocating motion of the key 16 in a radial direction.

Elastic means 43 furthermore act on the lower end of the rod 21 and elastically contrast the action of the piston 20 in order to obtain the return motion of the rod 2 when the fluid-actuated cylinder 19 is deactivated.

The second connecting means are constituted, in the illustrated embodiment, by blocks of magnetic material 23 which are fixed to the inner surface of the needle cylinder and arranged around the wing 14 of the platen; the portion 24 of the wing 14, which is located within the magnetic field generated by the blocks 23, is provided so as to use said magnetic field to produce, upon the rotation of the cylinder 2, which can be actuated in a known manner, a rotation of the platen 5 about the axis 2a.

As shown in FIGS. 1 to 4, the portion 24, which has an annular shape, faces the blocks 23 and can be made of ferromagnetic material. The core of the wing 14 is made of non-magnetic material, such as for example aluminum, in order to avoid magnetizations of adjacent elements, such as for example the needles.

Conveniently, the blocks 23 are applied on the inner surface of the needle cylinder between said needle cylinder and an axial duct 25, of a known type, which is arranged inside the needle cylinder and coaxially thereto; the sock or stocking descends into said duct as it is being knitted, whereas the portion 24 is arranged inside said duct.

The second connecting means can, more generally, be constituted by means for generating a magnetic field, which are fixed to the inner surface of the needle cylinder and arranged around the wing 14, and by means arranged on the wing 14 and adapted for using the magnetic field which is rotated by the rotation of the needle cylinder in order to induce a rotation of the platen about the axis *2a*.

Figure 5:
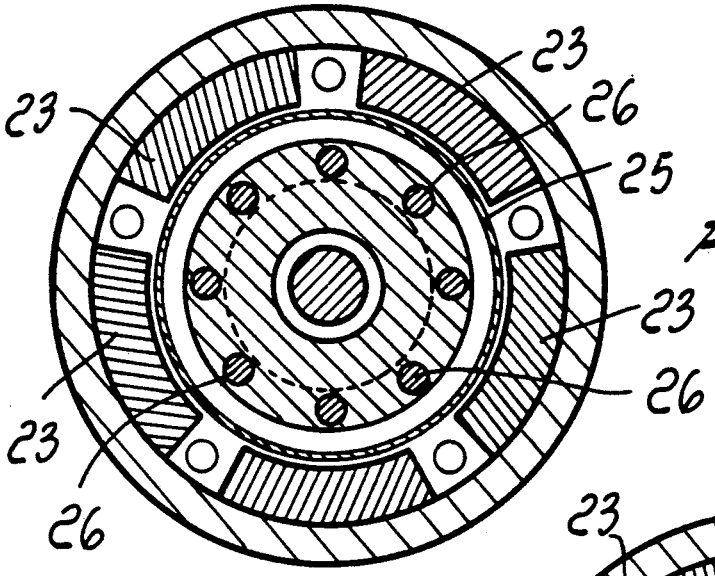
FIG. 5 is a schematic sectional view, taken similarly to FIG. 4, of another embodiment of the second connecting means according to the invention.

As shown by the embodiment illustrated in FIG. 5, the means adapted for using the magnetic field generated by the blocks 23 can comprise a structure, made of electrically conducting material, which is fixed to the wing 14 and is constituted by bars 26 arranged along a cylindrical surface coaxial to the needle cylinder. The bars 26 are mutually connected, at their two opposite ends, by two rings. In practice, said structure is executed like the rotor of a squirrel-cage asynchronous electric motor and can be fixed to a portion of the wing 14 which is made of electrically insulating material.

Figure 6:
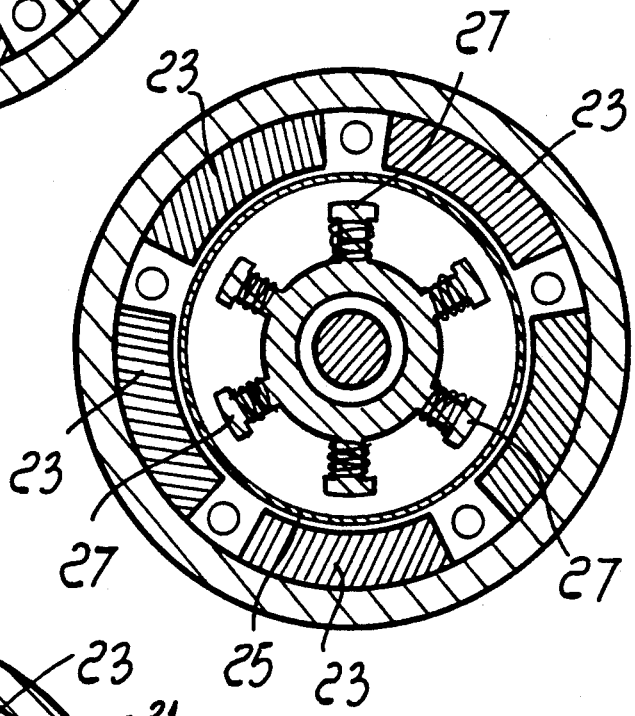
FIG. 6 is a schematic sectional view, taken similarly to FIG. 4, of a further embodiment of the second connecting means according to the invention.

As shown by the embodiment illustrated in FIG. 6, the means adapted for using the magnetic field generated by the blocks 23 can be constituted by metal strips 27 which have windings made of electrically conductive material, i.e. like the rotor of an asynchronous wound-rotor electric motor, are fixed to the wing 14 of the platen and are located within the magnetic field generated by the blocks 23.

Figure 7:
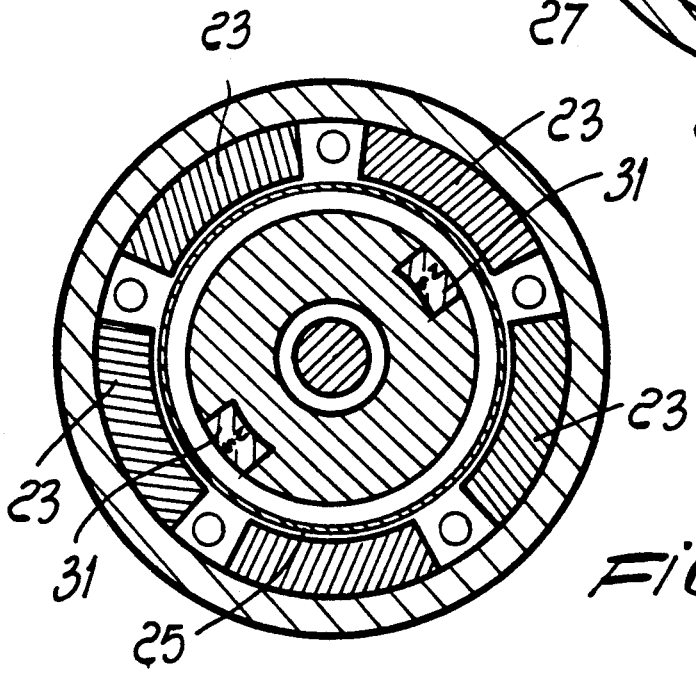
FIG. 7 is a schematic sectional view, taken similarly to FIG. 4, of another embodiment of the second connecting means according to the invention.

FIG. 7 illustrates a further embodiment of the means adapted for using the magnetic field generated by the blocks 23. Said means are constituted by at least two magnetic plates 31 fixed in diametrically opposite points of the non-magnetic core of the wing 14. The two plates 31 are orientated so as to define together a magnetic dipole which is rigidly associated with the wing 14 and is located within the magnetic field generated by the blocks 23.

In the embodiments illustrated in FIGS. 1 to 4 and 7, there is a direct action of the magnetic field generated by the blocks 23 on the ferromagnetic or magnetic material fixed to the wing 14, whereas in the embodiments illustrated in FIGS. 5 and 6 the magnetic field generated by the blocks 23 and rotated by the rotation of the needle cylinder induces currents in the conductors mounted on the wing 14 of the platen, consequently generating on said conductors mechanical forces which rotate the platen.

Advantageously, in order to allow the coupling of the key 16 to the seat 18 during the rotation of the needle cylinder, platen braking means are provided to reduce the rotational speed of the platen about the axis *2a* with respect to the needle cylinder.

More particularly, said braking means comprise a clutch 28 constituted by a slider 29 which is slideably associated with the arm 8 and can be actuated by means of a fluid-actuated cylinder 30. The slider 29 can engage against a portion of the shaft 9 in order to slow it down by friction.

The operation of the machine according to the invention is as follows.

When the knitting of the sock or stocking begins, during trimming, i.e. when the use of the hooks 7 is required, the platen 5 must be actuated with the same speed of rotation as the needle cylinder 2 and must be correctly arranged with respect thereto. For this reason, the fluid-actuated cylinder 19 is actuated and, by means of the rod 21, engages the key 16 in the seat 18.

Since the free length of the key 16 is extremely short, its torsional deformation is irrelevant and therefore the traction of the platen is very precise, as required in this step of the knitting.

As known, at the end of knitting the trimming or border of the sock or stocking, the hooks are generally no longer required for manufacturing the remainder of the stocking and are therefore retracted into the radial grooves 6 of the platen 5, in a known manner. When the hooks 7 are withdrawn from working upon completion of the border, the extension whereof is not such as to reach the key 16, the fluid-actuated cylinder 19 is deactivated, thereby disengaging the key 16 from the seat 18.

Despite the disengagement of the key 16 from the seat 18, the platen is in any case connected to the cylinder 2, in its rotation about the axis *2a*, by the second connecting means which use the magnetic field generated by the blocks 23. The rotation of the platen, although less precise, is such as to allow the correct use of the disk-shaped cutter 15 to cut the threads when required. It should be noted that the disengagement of the key 16 from the seat 18 allows the correct descent of the product along the axial duct 25.

In practice it has been observed that the machine according to the invention fully achieves the intended aim, since it allows a rotary actuation of the platen which can meet the knitting requirements without however requiring the use of a motor arranged outside the machine or of complicated gear transmissions and without creating hindrances to the descent of the product inside the needle cylinder or to its pneumatic tensioning.

The machine thus conceived is susceptible to numerous modifications and variations, all of which are within the scope of the inventive concept; thus, for example, the blocks 23 might be arranged on the wing 14, and the portion of the needle cylinder which faces the blocks 23 may be provided in ferromagnetic material.

All the details may furthermore be replaced with technically equivalent elements.

In practice, the materials employed, so long as compatible with the specific use, as well as the dimensions, may be any according to the requirements and to the state of the art.

We claim:

1. Single-cylinder circular machine with improved platen actuation, particularly for manufacturing socks and stockings, comprising;

a supporting structure;

a substantially vertical needle cylinder having a needle cylinder axis and an outer skirt, said needle cylinder being rotatable about said needle cylinder axis;

axial grooves defined in said outer skirt of said needle cylinder;

a plurality of needles arranged in said axial grooves and being individually movable along directions parallel to said needle cylinder axis;

a platen arranged coaxially above said needle cylinder, said platen being supported by said supporting structure and rotatable about said needle cylinder axis;

said machine further comprising;

first connecting means controllably activatable and disactivatable for rigidly rotationally associating said platen with said needle cylinder about said needle cylinder axis;

a wing connected to said platen and extending inside said needle cylinder;

an inner surface defined by said needle cylinder and having a portion facing said wing;

second connecting means arrange don said wing and on said portion of said inner surface of said needle cylinder facing said wing, said second connecting means interacting magnetically with one another, whereby to transmit rotary motion of said needle cylinder to said platen.

2. Machine according to claim 1, wherein said first connecting means comprise;

a key supported by said wing, and;

a seat defined on said portion of said inner surface of said needle cylinder facing said wing;

wherein said key is controllably movable along a substantially radial direction with respect to said needle cylinder, whereby to engage said seat.

3. Machine according to claim 2, wherein said seat is elongated along a direction, said direction being parallel to said needle cylinder axis.

4. Machine according to claim 1, further comprising platen braking means, said needle cylinder having a needle cylinder rotary speed and said platen having a platen rotary speed during operation of said machine, said platen braking means being operatable for reducing said platen rotary speed with respect to said needle cylinder rotary speed, whereby to allow coupling of said key with said seat.

5. Machine according to claim 4, wherein said braking means comprise;

a shaft rigidly associated with and extending above said platen, said shaft having a shaft axis and being rotatably supported by said supporting structure for rotation about said shaft axis, and;

a clutch arranged coaxial to said shaft and being controllably engageable with a portion of said shaft.

6. Machine according to claim 2, further comprising means for activating said key, said means for activating said key being arranged above said platen.

7. Machine according to claim 1, further comprising;

a portion of said supporting structure located above said platen;

a rod having a lower end, said rod being axially slideable in said shaft, said lower end being connected to said key;

a fluid-actuated cylinder having a piston, said fluid-actuated cylinder being arranged on said portion of said supporting structure located above said platen, said piston acting on said rod.

8. Machine according to claim 7, wherein said first connecting means comprise;

a key supported by said wing, and;

a seat defined on said portion of said inner surface of said needle cylinder facing said wing;

wherein said key is controllably movable along a substantially radial direction with respect to said needle cylinder, whereby to engage said seat, and wherein said lower end of said rod defines a sliding direction and has a shaped portion, said shaped portion defining a plane, said plane being inclined with respect to said sliding direction, whereby to radially move said key upon axial sliding said rod in said sliding direction.

9. Machine according to claim 7, wherein said first connecting means comprise;

a key supported by said wing, and;

a seat defined on said portion of said inner surface of said needle cylinder facing said wing;

a hole having opposite ends defined in said key, and;

two portions connected to said lower end of said rod;

wherein said key is controllably movable along a substantially radial direction with respect to said needle cylinder, whereby to engage said seat, and wherein said lower end of said rod defines a sliding direction and is coupled within said hole, said two portions being inclined with respect to said sliding direction, said hole having two opposite ends, said two inclined portions coupling against said two opposite ends of said hole along said substantially radial direction of said key for causing radial reciprocating motion of said key upon reciprocating axial motion of said rod.

10. Machine according to claim 1, wherein said second connecting means comprise;

a portion defined by said wing, said portion being at least partially made of ferromagnetic material and extending inside said needle cylinder, and;

blocks of magnetic material fixed to said inner surface of said needle cylinder and being arranged around said portion of said wing made of ferromagnetic material.

11. Machine according to claim 10, wherein said wing is constituted by a core of non-magnetic material, said core being covered by an annular portion, said annular portion being made of ferromagnetic material and located facing said blocks of magnetic material.

12. Machine according to claim 10, further comprising magnetic plates arranged on said wing, a magnetic field generated by said blocks, said magnetic plates defining a magnetic dipole, said magnetic dipole being rigidly associated with said wing and located within said magnetic field generated by said blocks.

13. Machine according to claim 1, wherein said second connecting means comprise;

means for generating a magnetic field, fixed to said inner surface of said needle cylinder and arranged around said wing, and;

means for using said magnetic field arranged on said wing;

wherein said wing is rotated upon the rotation of said needle cylinder, for an induced rotation of said platen about said needle cylinder axis.

14. Machine according to claim 13, wherein said means for using said magnetic field comprise a structure made of electrically conducting material, said structure being constituted by bars having two opposite ends, said bars being arranged along a cylindrical surface coaxial to said needle cylinder and being mutually connected at said two opposite ends by two rings, said structure being made of electrically conductive material and rigidly associated with a portion of said wing, said wing being made of electrically insulating material and located within said magnetic field.

15. Machine according to claim 13, wherein said means for using said magnetic field are constituted by a rotor of an asynchronous wound-rotor electric motor, said rotor being fixed, , to a portion of said wing coaxially to said platen and being located within said magnetic field.

16. Machine according to claim 1, further comprising a duct for permitting descent of a product being knitted, an outer surface defined by said duct, and means for generating a magnetic field, said wing extending inside said duct, said duct being arranged inside said needle cylinder and coaxially thereto, said means for generating a magnetic field being arranged between said outer surface of said duct and said inner surface of said needle cylinder.

* * * * *